United States Patent [19]

Johnson et al.

[11] Patent Number: 4,792,351

[45] Date of Patent: Dec. 20, 1988

[54] HYDROMETALLURGICAL PROCESS FOR PRODUCING IRREGULAR MORPHOLOGY POWDERS

[75] Inventors: Walter A. Johnson, Towanda; Nelson E. Kopatz, Sayre; Joseph E. Ritsko, Towanda, all of Pa.

[73] Assignee: GTE Products Corporation, Stamford, Conn.

[21] Appl. No.: 140,517

[22] Filed: Jan. 4, 1988

[51] Int. Cl.[4] ..... B22F 9/24

[52] U.S. Cl. ..... 75/0.5 A; 75/0.5 AA; 75/0.5 AB

[58] Field of Search ..... 75/0.5 A, 0.5 AA, 0.5 AB

[56] References Cited

U.S. PATENT DOCUMENTS

| | | | |
|---|---|---|---|
| 2,657,129 | 10/1953 | Stern et al. | 75/0.5 A |
| 2,665,981 | 1/1954 | Marquaire | 75/0.5 A |
| 3,305,349 | 2/1967 | Bovarnick et al. | 75/0.5 AA |
| 3,393,067 | 7/1968 | Alexander et al. | 75/0.5 AA |
| 3,663,318 | 5/1972 | Little, Jr. | 75/0.5 AA |
| 3,672,867 | 6/1972 | Little, Jr. | 75/0.5 AA |
| 3,684,484 | 8/1972 | Marchese et al. | 75/0.5 AA |
| 4,156,053 | 5/1979 | Baranow | 75/0.5 BC |
| 4,579,587 | 4/1986 | Grant et al. | 75/0.5 BB |
| 4,722,826 | 2/1988 | Poole | 75/0.5 AA |

OTHER PUBLICATIONS

Hampel et al., "The Encyclopedia of Chemistry" 3rd Ed., p. 1042 (van Nostrand Reinhold Company.

*Primary Examiner*—Wayland Stallard
*Attorney, Agent, or Firm*—Donald R. Castle

[57] ABSTRACT

A process for producing powder particles comprises forming an aqueous solution of the metal values of iron, cobalt, nickel and molybdenum, said metals being present in a predetermined ratio, forming from the solution a reducible solid material selected from the group consisting of salts of said metals, oxides of said metals, hydroxides of said metals and mixtures thereof, and reducing said material to form irregular shaped metallic powder particles.

9 Claims, No Drawings

HYDROMETALLURGICAL PROCESS FOR PRODUCING IRREGULAR MORPHOLOGY POWDERS

CROSS REFERENCE TO RELATED APPLICATIONS

This invention is related to the following applications: Ser. No. 054,557, filed 5/27/87, entitled, "Hydrometallurgical Process For Producing Finely Divided Spherical Metal Alloy Powders"; Ser. No. 026,312, filed 3/16/87, entitled, "Hydrometallurgical Process for Producing Finely Divided Spherial Refractory Metal Alloy Powders"; Ser. No. 028,824, filed 3/23/87, entitled, "Hydrometallurgical Process For Producing Finely Divided Spherical Low Melting Temperature Powders"; Ser. No. 026,222, filed 3/16/87, entitled, "Hydrometallurgical Process For Producing Finely Divided Spherical Precious Metal Alloy Powders"; Ser. No. 054,553, filed 5/27/87, entitled, "Hydrometallurgical Process For Producing Finely Divided Copper and Copper Alloy Powders"; Ser. No. 054,479, filed 5/27/87, entitled "Hydrometallurgical Process For Producing Finely Divided Iron Based Powders", all of which are by the same inventors as this application and assigned to the same assignee.

This invention is related to the following applications: Ser. No. 140,371, filed 1/4/88, entitled, "Hydrometallurgical Process For Producing Finely Divided Spherical Maraging Steel Powders"; Ser. No. 140,374, filed 1/4/88, entitled "Hydrometallurgical Process for Producing Irregular Shaped Powders With Readily Oxidizable Alloying Elements"; Ser. No. 140,701, filed 1/4/88, entitled "Hydrometallurgical Process For Producing Spherical Maraging Steel Powders With Readily Oxidizable Alloying Elements"; and Ser. No. 140,515, filed 1/4/88, entitled "Hydrometallurgical Process For Producing Spherical Maraging Steel Powders Utilizing Pre-Alloyed Spherical Powder and Elemental Oxidizable Species"; and Ser. No. 140,514, filed 1/4/88 entitled "Hydrometallurgical Process For Producing Finely Divided Spherical Maraging Steel Powders Containing Readily Oxidizable Alloying Elements", all of which are filed concurrently herewith and all of which are by the same inventors and assigned to the same assignee as the present application.

FIELD OF THE INVENTION

This invention relates to the preparation of irregular morphology powders suitable for conversion to maraging steel. More particularly, it relates to the production of such powder having substantially irregular particles by a hydrometallurgical process.

BACKGROUND OF THE INVENTION

Maraging steel is a term of the art derived from "martensite age hardening". These alloys are currently the iron- nickel-cobalt-molybdenum alloys as described in the cobalt monograph series entiltled "Cobalt-containing high strenth steels",Centre D'Information Du Cobalt, Brussels, 1974, pp. 50–51. Readily oxidizable metals such as Al, V and/or Ti at low levels e.g. 1% by weight or below can be added.

Metal alloy powders heretofore have been produced by gas or water atomization of molten ingots of the alloy. It has not been generally practical to produce the metal alloy powders directly from the individual metal powders because of the difficulty in obtaining uniformity of distribution of the metals.

U.S. Pat. No. 3,663,667 discloses a process for producing multimetal alloy powders. Thus, multimetal alloy powders are produced by a process wherein an aqueous solution of at least two thermally reducible metallic compounds and water is formed, the solution is atomized into droplets having a droplet size below about 150 microns in a chamber that contains a heated gas whereby discrete solid particles are formed and the particles are thereafter heated in a reducing atmosphere and at temperatures from those sufficient to reduce said metallic compounds to temperatures below the melting point of any of the metals in said alloy.

It is believed therefore that a relatively simple process which enables irregular shaped finely divided powders suitable for conversion to maraging steel, to be produced from sources of the individual metals is an advancement in the art.

SUMMARY OF THE INVENTION

In accordance with one aspect of this invention there is provided a process comprising forming an aqueous solution containing the metal values of iron, cobalt, nickel and molybdenum, wherein the metals are present in a predetermined ratio. Thereafter a reducible solid material selected from the group consisting of salts of said metals, oxides of said metals, hydroxides of said metals and mixtures thereof, is produced from the solution. This solid material material is reduced to form irregular shaped metallic powder particles.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

While it is preferred to use metal powders as starting materials in the practice of this invention because such materials dissolve more readily than other forms of metals, however, use of the powders is not essential. Metallic salts that are soluble in water or in an aqueous mineral acid can be used. When alloys are desired, the metallic ratio of the various metals in the subsequently formed solids of the salts, oxides or hydroxides can be calculated based upon the raw material input or the solid can be sampled and analyzed for the metal ratio in the case of alloys being produced. The metal values can be dissolved in any water soluble acid. The acids can include the mineral acids such as hydrochloric, sulfuric and nitric, as well as the organic acids such as acetic, formic and the like. Hydrochloric is especially preferred because of cost and availability.

After the metal sources are dissolved in the aqueous acid solution, the resulting solution can be subjected to sufficient heat to evaporate water. The metal compounds, for example, the oxides, hydroxides, sulfates, nitrates, chlorides, and the like, will precipitate from the solution under certain pH conditions. The solid materials can be separated from the resulting aqueous phase or the evaporation can be continued. Continued evaporation results in forming particles of a residue consisting of the metallic compounds. In some instances, when the evaporation is done in air, the metal compounds may be the hydroxides, oxides or mixtures of the mineral acid salts of the metals and the metal hydroxides or oxides. The residue may be agglomerated and contain oversized particles. The average particle size of the materials can be reduced in size by milling, grinding or by other conventional methods of particle size reduction.

After the particles are reduced to the desired size they are heated in a reducing atmosphere at a temperature above the reducing temperature of the salts but below the melting point of the metals in the particles. The temperature is sufficient to evolve any water of hydration and the anion. If hydrochloric acid is used and there is water of hydration present, the resulting wet hydrochloric acid evolution is very corrosive thus appropriate materials of construction must be used. The temperatures employed are below the melting point of any of the metals therein but sufficiently high to reduce and leave only the cation portion of the original molecule. In most instances a temperature of at least about 500° C. is required to reduce the compounds. Temperatures below about 500° C. can cause insufficient reduction while temperatures above the melting point of the metal result in large fused agglomerates. If more than one metal is present the metals in the resulting multimetal particles can either be combined as intermetallics or as solid solutions of the various metal components. In any event there is a homogenous distribution throughout each particle of each of the metals. The particles are generally irregular in shape. If agglomeration has occurred during the reduction step, particle size reduction by conventional milling, grinding and the like can be done to achieve a desired average particle size for example less than about 20 micrometers with at least 50% being below about 20 micrometers. The powders thereafter can be converted to the maraging steel in either powder or in a consolidated form such as a billet by conventional sintering techniques known to those skilled in the powder metallurgy art.

To further illustrate this invention, the following non-limiting example is presented. All parts, proportions and percentages are by weight unless otherwise indicated.

EXAMPLE

About 670 parts of iron powder and about 180 parts of nickel powder and about 100 parts of cobalt are dissolved in about 4000 parts of 10N HCl using a glass lined agitated reactor. About 50 parts of molybdenum as a solution of ammonium molybdate are added to this.

Ammonium hydroxide is added to a PH of about 6.5–7.5. The iron, nickel, cobalt and molybdenum are precipitated as an intimate mixture of hydroxides. This mixture is then evaporated to dryness. The mixture is then heated to about 350° C. in air for about 3 hours to remove the excess ammonium chloride. This mixture is then hammermilled to produce a powder having a particle size essentially less than 250 micrometers. Milling and hydrometallurgical parameters can be controlled to achieve a powder having greater than 50% of the particles smaller than about 50 micrometers with no particles divided particles containing 67% iron, 18% nickel, 10% cobalt and 5% molybdenum are formed.

Irregular morphology maraging steel alloy powder is produced from these powders by heating at conventional temperatures to convert the powders to an alloy containing Fe, Ni, Co and Mo, in a fully soft (annealed) condition, thus its morphology and hardness make it an attractive powder in applications that require high green strength, such as cold press and cold isostatic pressing, without the need for a binder. The Fe, Ni, Co and Mo quaternary compositions are used to achieve a high strength consolidated product. Hydrometallurgical processing eliminates the need for aluminum additions which are required in normal cast wrought melt practices. Titanium additions useful for higher strength in cast/wrought processes can be avoided in this hydrometallurgical-powder metallurgical consolidation technique, through the utilization of finer grain size, refined microstructure and higher concentration of alloying additions.

While there has been shown and described what are considered the preferred embodiments of the invention, it will be obvious to those skilled in the art that various changes and modifications may be made therein without departing from the scope of the invention as defined by the appended claims.

What is claimed:

1. A process comprising:

(a) forming an aqueous solution containing the metal values of iron, cobalt, nickel and molybdenum, said metals being present in a predetermined ratio, (b) forming from said solution a reducible solid material selected from the group consisting of salts of said metals, oxides of said metals, hydroxides of said metals and mixtures thereof, and (c) reducing said material at a temperature below the melting point of any of the metals to form unalloyed irregular shaped metallic powder particles suitable for conversion to a maraging steel alloy.

2. A process according to claim 1 wherein said solution contains a mineral acid selected from the group consisting of hydrochloric, sulfuric and nitric acids.

3. A process according to claim 2 wherein said mineral acid is hydrochloric acid.

4. A process according to claim 1 wherein said aqueous solution contains a water soluble acid.

5. A process according to claim 2 wherein said reducible solid material is formed by evaporation of the water from the solution.

6. A process according to claim 2 werein said reducible solid material is formed by adjusting the pH of the solution to form a solid which is separated from the resulting aqueous phase.

7. A process according to claim 1 wherein said material produced by step (b) is subjected to a particle size reduction step prior to the reduction step (c).

8. A process according to claim 1 wherein at least 50% of said particles have a size less than about 20 micrometers.

9. A composition produced by the process of claim 1 wherein said particles have an irregular shaped mor-